US005261588A

United States Patent [19]

Lin

[11] Patent Number: 5,261,588

[45] Date of Patent: Nov. 16, 1993

[54] IMPROVEMENT FOR A NAILING GUN

[76] Inventor: Joseph Lin, No. 13-3, Yuh Der Rd., Taichung, Taiwan

[21] Appl. No.: 886,900

[22] Filed: May 22, 1992

[51] Int. Cl.[5] ..... B25C 7/00

[52] U.S. Cl. ..... 227/110; 227/120; 227/148; 227/156

[58] Field of Search ..... 227/110, 111, 120, 148, 227/124, 128, 151, 152, 156

[56] References Cited

U.S. PATENT DOCUMENTS

| | | | |
|---|---|---|---|
| 1,909,369 | 5/1933 | MacKenzie | 227/156 |
| 2,888,680 | 6/1959 | Krivis | 227/110 |
| 2,915,754 | 12/1959 | Wandel | 227/111 |
| 3,305,156 | 2/1967 | Khan | 227/110 |
| 3,822,817 | 7/1974 | Umphress | 227/110 |
| 4,025,031 | 5/1977 | Chi | 227/156 |
| 4,346,831 | 8/1982 | Haytayan | 227/156 |
| 5,054,678 | 10/1991 | Nasiatka | 227/148 |

*Primary Examiner*—Douglas D. Watts
*Assistant Examiner*—Scott A. Smith
*Attorney, Agent, or Firm*—Browdy and Neimark

[57] ABSTRACT

An auxiliary slidable abutment is pivotally mounted on the nail cartridge of a nailing gun in such manners that it slides in a direction consistent with axis of the nail cartridge, and that it can be locked at any given point of its sliding course, and further that its bottom extends downward beyond the nail cartridge. It provides the nailing gun with the capability of doing things, such as driving with precision the nails onto a workpiece at the prescribed intervals, driving the nails with precision onto the fastened area of a horizontal board and a vertical board, and driving the nails onto a workpiece at a prescribed angle and with precision.

7 Claims, 4 Drawing Sheets

IMPROVEMENT FOR A NAILING GUN

BACKGROUND OF THE INVENTION

The present invention relates to an improvement for a nailing gun, and more particularly to a slidable abutment means and associated measuring scales for use in enhancing the operational efficiency and precision of a nailing gun.

The prior art nailing guns are generally defective in design in that it is always difficult for a worker using such nailing gun to control the nailing to take place equidistantly, and that the results of nailing operation can be quite unsatisfactory in a situation calling for a vertical board to be fastened onto a horizontal board with nails, and further that it is difficult for a worker using such prior art nailing gun to drive with precision the nail onto something at a prescribed angle.

The shortcomings of the prior art nailing gun described above can be overcome by an extra work on the part of a worker, who must mark in advance on a workpiece a nailing line or nailing intervals so as to ensure that the nailing takes place as desired. Such extra work demands additional tools and time and therefore incurs additional expense.

SUMMARY OF THE INVENTION

It is, therefore, the primary objective of the present invention to provide an improvement form nailing gun permitting the nailing intervals to take place according to the prescribed intervals.

It is another objective of the present invention to provide an improvement for a nailing gun which permits the user to drive the nails onto an object along a line parallel to a predetermined reference line on the object.

It is still another objective of the present invention to provide an improvement for a nailing gun comprising a slidable abutment means and associated measuring scales, which enables a worker using the nailing gun to drive the nail onto an object in an angle consonant with a prescribed angle.

In keeping with the principles of the present invention, the foregoing objectives of the present invention are accomplished by a nailing gun having a slidable abutment means which is attached to a nail cartridge of the nail gun which is capable of sliding and of being locked along a direction consistent with the axis of the nail cartridge and is provided with a bottom portion extending downward beyond the nail cartridge.

In operation, the nailing interval is corresponding to the distance between the bottom portion of the slidable abutment means and the muzzle, which remain on the same horizontal surface. In a situation in which the bottom portion of the slidable abutment means extends further downward to an extent that it does not remain on the same horizontal surface with the muzzle, the slidable abutment means is set against a reference surface. The nails can be driven onto an object by the nailing gun placed in a position parallel to the reference surface so as to prevent the driven nails from missing the intended targets. In addition, the nails can be driven equiangularly onto a workpiece against which the nailing gun is set, at the time when the bottom portions of the slidable abutment means and, the muzzle and an axial line of the nail cartridge are arranged to form a right triangle.

The foregoing objectives and features of the present invention will be better understood by studying the following detailed description of a preferred embodiment of the present invention in conjunction with the drawings provided herewith.

DETAILED DESCRIPTION OF THE PREFERRED EMBODIMENT

Figure 1:
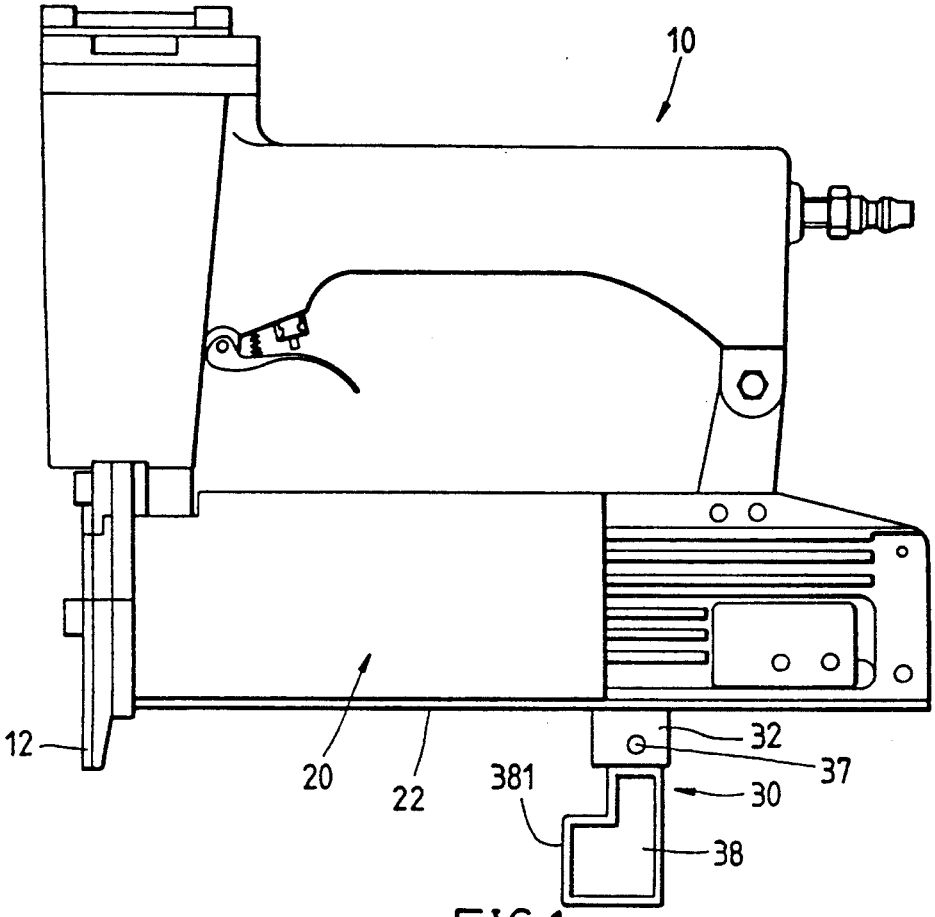
FIG. 1 shows a schematic view of a slidable abutment means of the present invention mounted on nail cartridge of a nailing gun.
Figure 2:
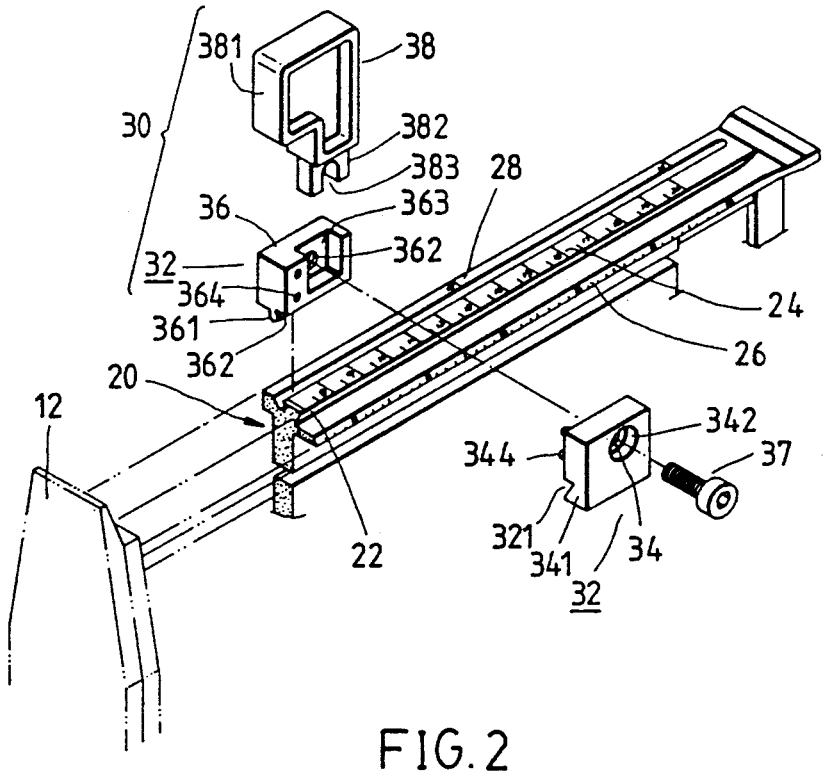
FIG. 2 shows an exploded view of a portion taken from the bottom as shown in FIG. 1.

Referring to FIGS. 1 and 2, an slidable abutment means 30 of the present invention is shown being slidably mounted on a nail cartridge 20 of a nailing gun 10.

The nail cartridge 20 has a rail 22 arranged axially at the bottom thereof and having a shape of dovetail in its cross section. The rail 22 has metric scale 24, British scale 26 and angle scale 28 marked thereon. Such measuring scales are taken on the basis of a muzzle 12 of the nailing gun 10, which is used as a reference.

The slidable abutment means 30 is slidably mounted on the rail 22 of the nail cartridge 20 and is composed of a main body 32 having a left portion 34 and a right portion 36, which are provided respectively with a bevel 341 having a threaded hole 342 and with a bevel 361 having a threaded hole 362. The right portion 36 has a recess 363 and two cuts 364 serving to receive two projecting parts 344 of the left portion 34. Located between the two bevels 341 and 361 is a notch 321 having a shape of dovetail in its cross section. The main body 32 is slidably mounted on the rail 22 by means of the notch 321. The length of bottom portion of the main body 32 extending beyond the bottom of nail cartridge 20 is equal to the length of the muzzle 12 extending out of the nailing gun 10. As a result, both the muzzle 12 and the bottom portion of the main body 32 are of same level and are capable of setting on the same horizontal surface. The left portion 34 and the right portion 36 are held securely together by means of a bolt 37, which is received in the threaded holes 342 and 362, in such a manner that bevels 341 and 361 are secured to the sides of the rail 22 so as to lock the main body 32 on the rail 22.

A reference piece 38 having an L shape and a predetermined length is furnished with a reference surface 381 extending forward from the front side thereof. Located at the top end of the reference piece 38 is a projection 382 having a slot 383. The reference piece 38 is united with the main body 32 by means of the projection 382, which is received in the recess 363 of the main body 32. In addition, the reference piece 38 is secured in place by the projection 382, which is firmly sandwiched between the left and the right portions 34 and 36. The reference piece 38 is capable of extending a predetermined length exceeding the length that the muzzle 12 is able to draw out.

Figure 3:
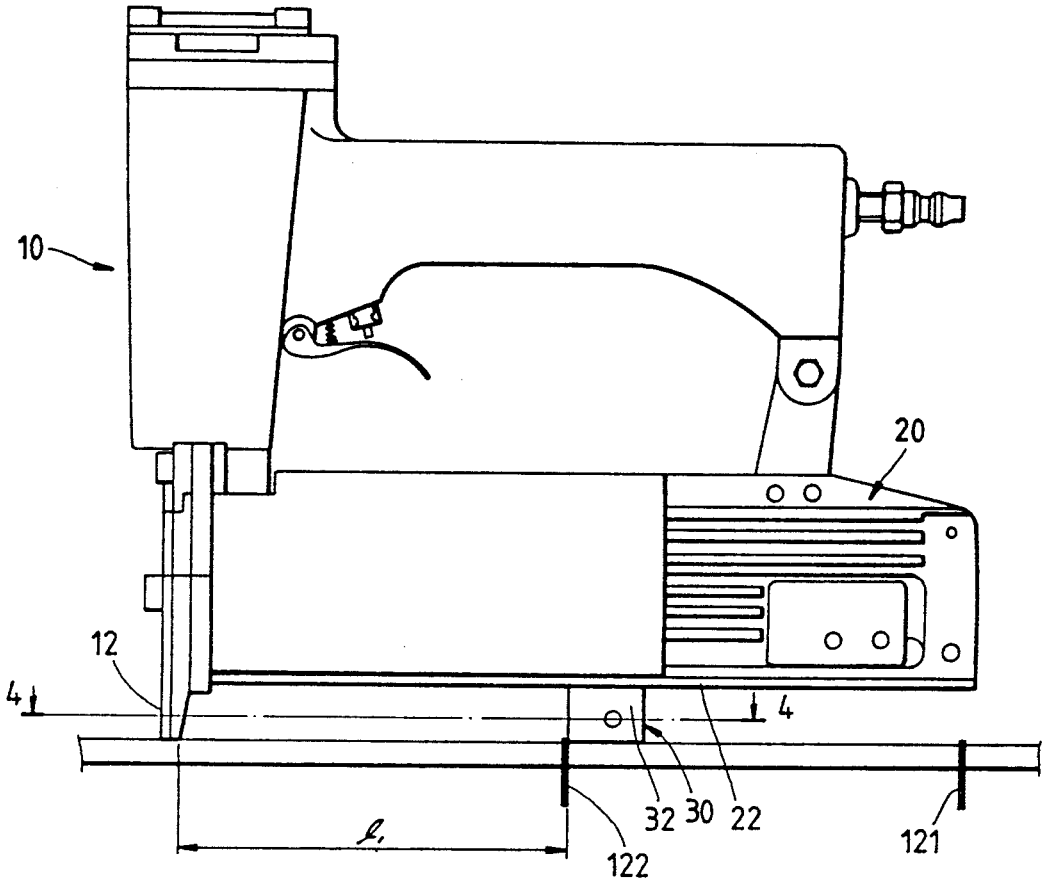
FIG. 3 shows a schematic view of the present invention at work.
Figure 4:
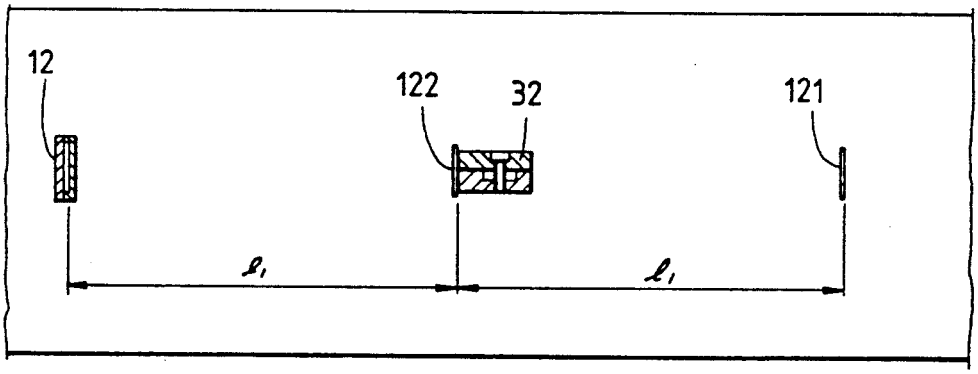
FIG. 4 shows a sectional view of a portion taken along the line 4—4 as shown in FIG. 3.

Now referring to FIGS. 3 and 4, the main body 32 is shown mounting on the rail 22 without the reference piece 38, which has been dismounted. As a result, the bottom of the main body 32 and the muzzle 12 are now on the same level. If one desires to nail a workpiece at an interval l1, such as 15 cm, the main body 32 must be slided along the rail 22 until the front end of the main body 32 is in alignment with the mark of 15 cm on the scale. The main body 32 is then locked at that position, thereby resulting in a distance of 15 cm or l1 between the front end of the main body 32 and the muzzle 12. The nailing gun 10 is now ready to drive the first nail 121 onto a workpiece. Upon completion of the first nailing, the nailing gun 10 is moved in such a manner that the front end of the main body 32 lines up with the first nail 121 before the second nail 122 is driven out onto the workpiece. The distance between the first nail 121 and the second nail 122 will be l1 or 15 cm. The nailing gun 10 is moved on in a similar fashion as described. All the nails driven out onto the workpiece are therefore spaced apart at an equal interval of l1 or 15 cm.

Figure 5:
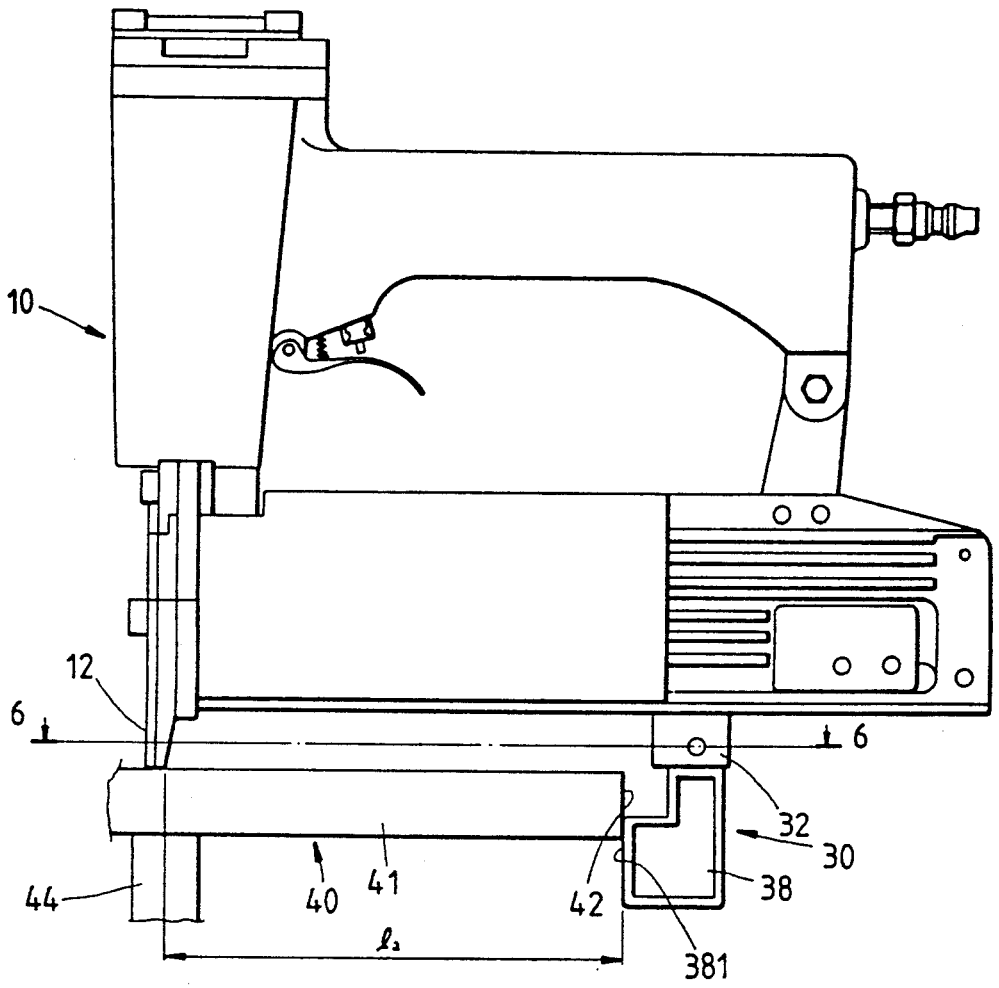
FIG. 5 shows another schematic view of the present invention at work.
Figure 6:
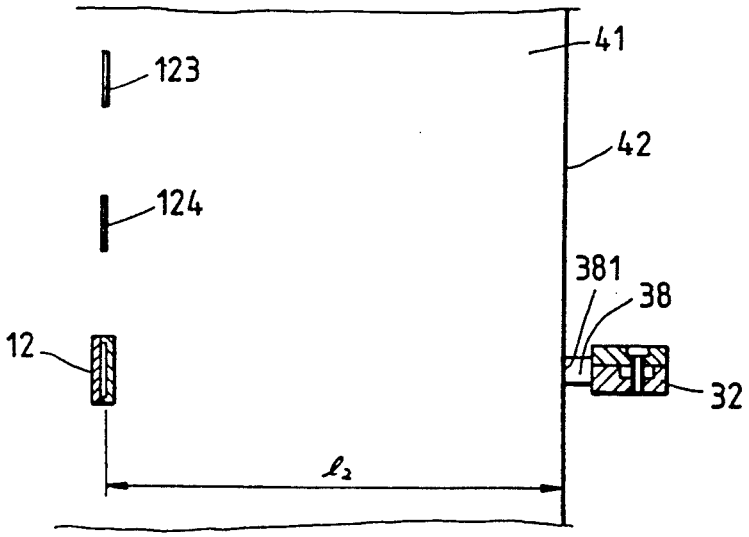
FIG. 6 shows a sectional view of a portion taken along the line 6—6 as shown in FIG. 5.

The working of the present invention is further illustrated in FIGS. 5 and 6, in which a vertical board is fastened onto a horizontal board with nails. In operation, the reference piece 38 is mounted on the main body 32 so that the bottom of the slidable abutment means 30 extends downward a predetermined length which exceeds the length that the muzzle 12 extends. Select the edge of shoulder 41 of a horizontal board 40 as a base surface 42. The position of the slidable abutment means 30 is adjusted to the mark of l2 on the scale so that the distance between the reference surface 381 and the muzzle 12 is equal to l2, which is corresponding to the distance between the base surface 42 and the center of the top edge of the vertical board 44. The reference surface 381 is set against the base surface 42 so that the first nail 123 is driven out of the muzzle 12 to hit with precision onto the center of the top edge of the vertical board 44 and the horizontal board 40. Thereafter, the nailing gun 10 is moved along the base surface 42 for a predetermined distance before the second nail 124 is driven out. Both nails 123 and 124 so driven out are right on the targets in the vertical board 44 and are spaced apart from the base surface 42 at an interval of l2.

Figure 7:
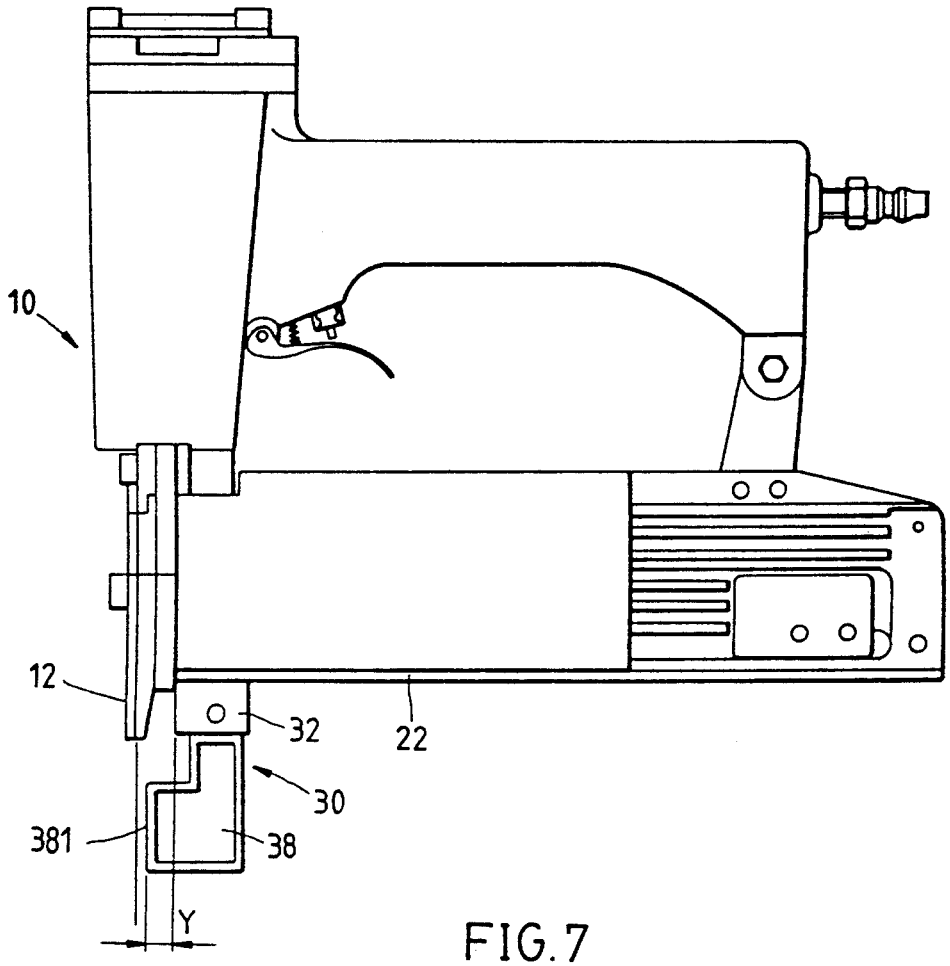
FIG. 7 is similar to FIG. 5, showing that the reference surface of the slidable abutment means and the muzzle remain apart by a small distance.

It must be noted here that there is a positional difference Y between the reference surface 381 and the front end of the main body 32, as shown in FIG. 7. As a result, the reference surface 381 and the muzzle 12 are spaced apart slightly at the time when the main body 32 is located at the extreme front end of the rail 22. Accordingly, the muzzle 12 is permitted to drive the nail out under the circumstance that the muzzle 12 is spaced apart slightly from the selected base surface. In fact, there is a positional difference Y between the distance separating the reference surface 381 and the muzzle 12 and the distance measured by the main body 32. Therefore, the user of the nailing gun is aware of the actual distance between the reference surface 381 and the muzzle 12.

Figure 9:
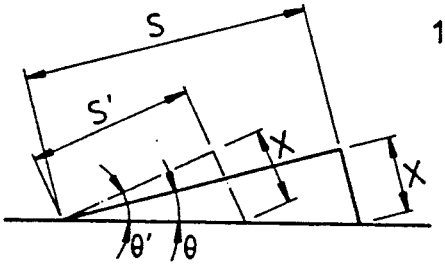
FIG. 9 is a further illustration of FIG. 8.
Figure 8:
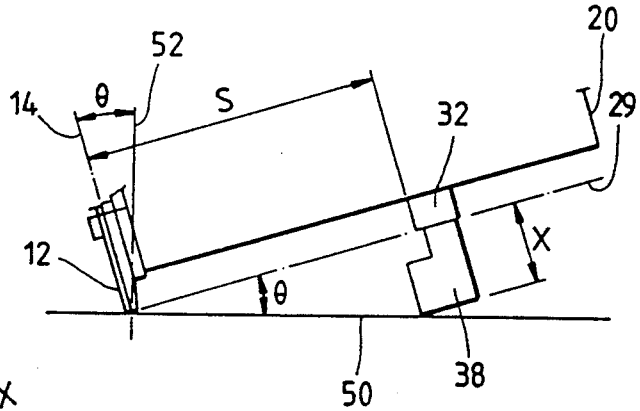
FIG. 8 shows still another schematic view of the present invention at work.

As shown in FIG. 8, the bottom edge of the reference piece 38 and the muzzle 12 are set on a workpiece surface 50. The bottom of slidable abutment means 30, the bottom of muzzle 12 and the axis 29 of the nail cartridge 20 form a right triangle with workpiece surface 50. The angle $\theta$ formed by the axis 14 of the muzzle 12 and the normal line 52 of the workpiece surface 50 can be determined on the angle scale 28 by setting main body 32 on scale 28. In other words, the reading of angle $\theta$ is readily shown at a point of the angle scale 28, where it is in alignment with the front end of the main body 32. According to FIG. 9, the value of the angle $\theta$ can be determined by an equation of $$\tan\theta = \frac{X}{S}, \text{ or } \theta = \tan\frac{-X}{S},$$

in which X is the length of the reference piece 38 while S represents the distance between the auxiliary driving means 30 and the muzzle 12. The angle formed by the axis 14 of the muzzle 12 and the normal line 52 of the workpiece surface 50 is represented by an equation of $$\theta' = \tan^{-1}\frac{X}{S'},$$

in which X is constant. Therefore, all nails are driven out by the nailing gun 10 onto a workpiece in such a manner that they enter the workpiece at an angle, without missing the target.

The present invention is characterized in that it permits a nailing gun to drive the nails onto a workpiece at the prescribed intervals, and that it facilitates a nailing gun to drive the nails with precision onto the fastened area of a horizontal board and a vertical board, and further that it provides a nailing gun with means capable of driving the nails onto a workpiece at a prescribed angle and with precision.

The embodiment of the present invention described above is to be considered in all respects as merely illustrative and not restrictive. Accordingly, the present invention may be embodied in other specific forms without deviating from the spirit thereof. Therefore, the present invention is to be limited only by the scope of the hereinafter appended claims.

What is claimed is:

1. An improvement for a nailing gun, said improvement comprising;

a slidable abutment slidably engaged on a nail cartridge of said nailing gun, a plurality of measuring scales along a length of surfaces on said nail cartridge adjacent to said slidable abutment, said slidable abutment projecting from said nail cartridge in the same direction as a nailing muzzle of said nailing gun, locking means on said slidable abutment for locking said slidable abutment to said nail cartridge, a rail on said nail cartridge along said length of surfaces, said slidable abutment comprising, a main body engaged to said rail and having a recess spaced opposite from said rail, and a reference piece for selective engagement to said main body and having a reference surface and a projection corresponding to said recess, said reference piece being selectively engaged to said main body by inserting and fastening said projection in said recess, wherein, when said reference piece is disengaged from said main body, said main body can be locked adjacent a marked distance on one of said plurality of scales to set said distance between a face of said main body and said nailing muzzle to allow positioning of said nailing muzzle and said main body on a surface of a workpiece to fix a nail said distance from a selected reference point on said workpiece, and when said reference piece is engaged to said main body, said main body can be locked adjacent a marked angle on another one of said plurality of scales to set said angle and allow positioning of said nailing muzzle and said reference piece on a surface of a workpiece to fix a nail at said angle.

2. The improvement according to claim 1, wherein, said rail has a dovetail cross section engaging a corresponding dovetail slot on said main body.

3. The improvement according to claim 1, wherein, said plurality of measuring scales comprises, a metric scale, and an angle scale.

4. The improvement according to claim 1, wherein, said nailing muzzle and said main body project the same distance form said nail carriage.

5. The improvement according to claim 1, wherein, said slidable abutment with said reference piece engaged projects a greater distance from said nail carriage than said nailing muzzle and an axis of both said slidable abutment including said reference piece and said nailing muzzle are perpendicular to an axis of said nail carriage.

6. The improvement according to claim 1, wherein, said reference surface of said reference piece when engaged to said main body and said face of said main body are located on spaced apart parallel planes perpendicular to said axis of said nail cartridge.

7. The improvement according to claim 1, wherein, when said reference piece is engaged to said main body, said main body can be locked adjacent a marked distance on said one of said plurality of scales to set said distance between said reference surface of said reference piece and said nailing muzzle to allow positioning of said nailing muzzle on a surface of a workpiece and said reference surface against an edge of said workpiece to fix a nail said distance from said edge.

* * * * *